US005907933A

United States Patent [19]

Stanfill

[11] Patent Number: 5,907,933

[45] Date of Patent: Jun. 1, 1999

[54] MOBILE HOME SKIRTING ASSEMBLY

[76] Inventor: Donald E. Stanfill, 972 Whitmoor Dr., St. Charles, Mo. 63301

[21] Appl. No.: 08/934,266

[22] Filed: Sep. 19, 1997

[51] Int. Cl.[6] ..... E04C 1/30

[52] U.S. Cl. ..... 52/169.12; 52/217

[58] Field of Search ..... 52/169.12, 155, 52/674, DIG. 13, 217

[56] References Cited

U.S. PATENT DOCUMENTS

| | | | |
|---|---|---|---|
| Re. 28,987 | 10/1976 | Iacona | 52/DIG. 3 |
| 3,106,411 | 10/1963 | Holmes | 52/169.12 |
| 3,571,998 | 3/1971 | Iacona | 52/478 |
| 3,722,156 | 3/1973 | Bryant | 52/169.12 |
| 3,753,323 | 8/1973 | Nesbitt | 52/169.12 |
| 3,775,917 | 12/1973 | Struben | 52/169.12 |
| 3,827,201 | 8/1974 | Struben | 52/169.12 |
| 3,832,813 | 9/1974 | Hindman | 52/169.12 |
| 3,834,109 | 9/1974 | Iacona | 52/DIG. 3 |
| 4,043,088 | 8/1977 | Payton | 52/169.9 |
| 4,214,412 | 7/1980 | Barylski | 52/169.12 |
| 4,531,337 | 7/1985 | Holdiman | 52/217 |
| 4,549,378 | 10/1985 | Ayers et al. | 52/169.12 |
| 4,843,793 | 7/1989 | Ayers | 52/169.12 |
| 4,972,640 | 11/1990 | DiFazio | 52/211 |
| 4,996,807 | 3/1991 | Walgamuth | 52/169.12 |

*Primary Examiner*—Beth A. Aubrey
*Attorney, Agent, or Firm*—Summers, Compton, Wells & Hamburg, P.C.

[57] ABSTRACT

An improved mobile home skirting assembly includes a mounting channel with barbs projecting into the channel to engage protrusions on skirting panels inserted into the channel, locking the panels into place with the mounting channel.

16 Claims, 4 Drawing Sheets

MOBILE HOME SKIRTING ASSEMBLY

BACKGROUND OF THE INVENTION

This invention relates generally to mounting assemblies, and more particularly to a mounting assembly for the skirting of mobile homes.

For aesthetic reasons, a mobile home is usually finished with skirting around the bottom perimeter of the home. The skirting conceals from view the bottom support structure of the mobile home floor and the wheels and/or axles of the mobile home. A typical mounting assembly for mobile home skirting is shown in FIGS. 1 and 2, generally indicated by the reference numeral 10. Skirting panels 11, typically made of vinyl siding, are attached to the mobile home 12 along its bottom and extend downward toward the ground into a mounting channel 13 fixed to the ground 14 by suitable means, for example, the spike 15 of FIG. 2. Panels are attached side-by-side with portions of adjacent vertical edges overlapping. A typical panel is generally square with opposite top and bottom horizontal edges and opposite left and right vertical edges. Typical dimensions are 2 feet×2 feet, but these could vary. The top edges of the panels are attached around the bottom perimeter of the mobile home according to various known methods. The bottom horizontal edge of each panel is provided with a projecting tab or protrusion 17 that holds the bottom edge in the channel as will be explained.

A mounting channel for mobile home skirting, known in the trade as a "ground channel" or "ground rail" is made of the same or similar material as is the skirting The channel is post-formed or bent into a channel shape or U-shape with the opening into an interior groove of the channel being positioned at the top of the channel in use. A front wall of the channel has a top edge that is bent over forming a lip 16 along the top edge that extends downwardly into the channel groove a short distance. When a skirting panel is inserted into the channel groove, the lip 16 passes over the panel protrusion 17 and serves to keep the mounting channel 13 in proximity to the skirting panel 11. As shown is FIG. 2, if the mounting channel 13 displaces vertically a sufficient distance, the lip 16 on the interior surface of the mounting channel engages the series of protrusions 17 or "button punches" on the lower edge of the skirting panel 11 to keep the mounting channel 13 from separating with the skirting panels 11. The "button punch" is typical of prior art panels and is formed by displacing a small tab or protrusion of the material of the skirting panel outwardly from the front surface of the panel as shown in FIG. 2.

This assembly of skirting panels and a mounting channel can be problematic. The vertical distance between the bottom perimeter of the mobil home from which the panels are suspended and the surface of the ground supporting the channels varies around the perimeter of the mobile home. This often results in the panel protrusion 17 being positioned well below the channel lip in the groove of the channel. Therefore, the connection between the panels and the mounting channels tends to be loose. As a result, the mounting channel often neither supports nor is supported by the skirting panels. This poor connection effectively decouples the structural integrity of the skirting panels and the mounting channels, which increases the possibility of and contributes to the mounting channel dislodging from the ground, causing the channel to move with respect to the skirting. Aside from this being unsightly, this may contribute to shearing of the skirting during heavy winds, rains and snows. Thus, the present mounting channels require continuing maintenance to preserve a pleasing appearance of the mobile home skirting and to ensure structural integrity between the skirt, the channel, and the ground.

SUMMARY OF THE INVENTION

Among the several objects of the present invention may be noted the provision of an improved mobile home skirting assembly; the provision of a relatively rigid connection between a mounting channel and a skirting panel; the provision of a locking connection to fix skirting panels to a mounting channel; and the provision of a mounting assembly that may be used on sloped mounting surfaces and yet maintain a structurally rigid and locked connection between a skirting panel and a mounting channel. A further object of the invention is the provision of an improved method for mounting mobile home skirting Generally, the mounting assembly of the present invention comprises a plurality of skirting panels and mounting channels sufficient in number to surround the bottom perimeter of a mobile home. To simplify the description of the invention, only one mounting channel and its associated plurality of skirting panels will be described.

The skirting panels or siding panels are substantially the same as those of the prior art. The panel is generally square with opposite top and bottom horizontal edges, and opposite left and right vertical edges. The panels are provided with a number of protrusions spaced horizontally along the length of the panel and spaced a short vertical distance above their bottom edge. These protrusions are known as "button punches" in the trade. Although there are numerous ways to accomplish the effect of a button punch, they are typically formed with a three sided punch. That is, a slit is punched on three sides; the top, and the opposite sides of a tab, and the remaining side is bent outwardly to form a tab or button protruding outwardly and upwardly from the side of the panel, hence the button punch.

The mounting channel of the present invention is preformed, as opposed to the post-formed mounting channels of the prior art and is therefore quite rigid when compared to its preformed predecessors. The channel has an elongated length and a general U-shaped cross-section with a horizontal base at its bottom, a vertical front wall and a vertical back wall. A groove with a top opening is defined by interior surfaces of the front and back walls and the bottom base. The mounting channel of the present invention is also equipped with rows of barbs on the interior surface of the channel front wall. The barbs project into the mounting channel groove at different vertical spacings to engage the button punches of a skirting panel as panels are inserted into the mounting channel groove. When the mounting channel barbs are properly positioned to match the location of the button punches, or vice versa, the barbs can be used to lock the panels to the channel as the panels are inserted in the channel.

This locking effect creates a rigid, sturdy connection between the mounting channel and the skirting panels. In turn, this creates a more rigid connection to the ground. Thus the present invention avoids the decoupling structural effects of the prior art due to a loose connection and vertical play between the panels and the channel are avoided. The resulting connection and support between the skirting panels, the mounting channel, and the ground thereby increases the strength of the connection, reduces maintenance on the assembly, and resists weather more capably than before.

The same apparatus or method of mounting the skirting could be provided at the perimeter of the mobile home flooring and the top edges of the side panels and used to mount the skirting panels to the mobile home as well. The rigid locking connection of the present invention also has benefits extending well beyond the application of mobile home skirting, and nothing in this application is intended to restrict the application of the invention to mobile home finishing.

DESCRIPTION OF THE PREFERRED EMBODIMENT

The skirting assembly of the present invention is basically comprised of two component parts, a skirting panel or side panel 20 and a mounting channel 22. In the illustrative environment of the invention to be described, the skirting assembly is employed on a mobile home. The assembly is suspended from the perimeter of the mobile home at the level of its floor to conceal the supporting frame, wheels and/or axles of the mobile home from view outside the mobile home. It should be understood that the described use of the skirting assembly of the invention on a mobile home is illustrative only, and that the skirting assembly of the invention may be employed in a variety of other environments.

In the preferred embodiment of the invention, the skirting panel 20 and mounting channel 22 are both molded of a plastic material similar to the same types of plastics employed in constructing vinyl siding for housing. Alternatively, other types of materials may be used to construct the panels and channels of the invention, for example, aluminum. In actual use of the invention, a sufficient number of panels and lengths of mounting channel are employed to surround the entire periphery of the mobile home as is done in the prior art. In order to simplify the description of the invention, only one mounting channel 22 and its associated plurality of skirting panels 20 will be described.

Figure 1:
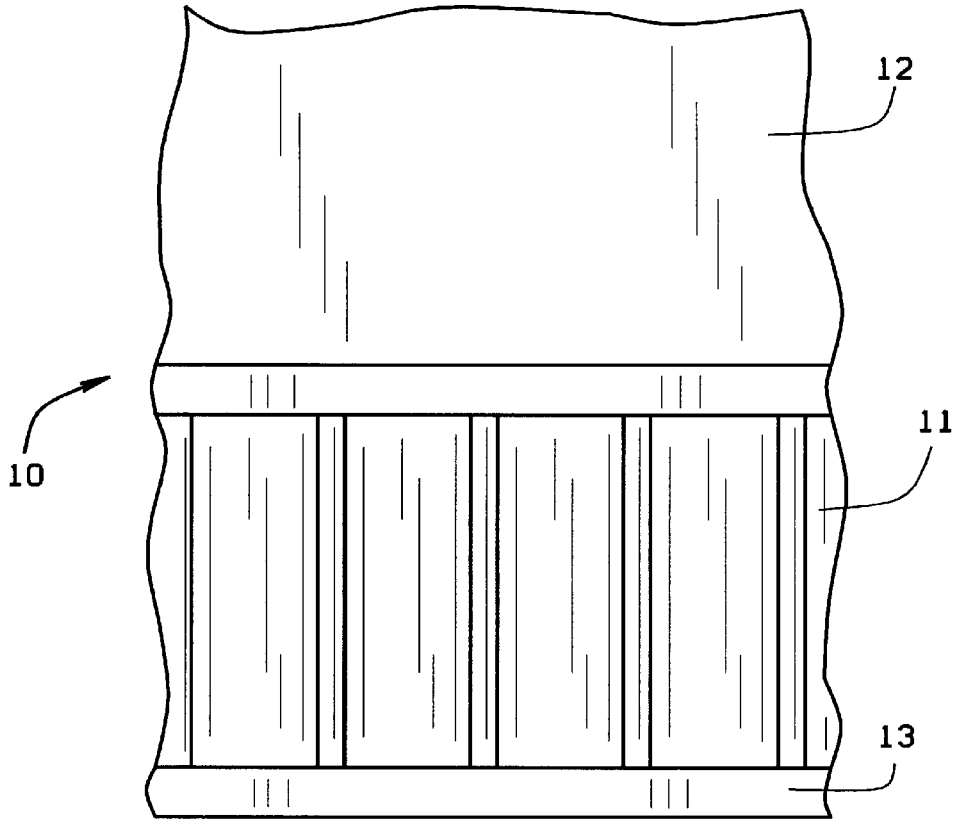
FIG. 1 PRIOR ART
FIG. 1 is a front elevation view of a mobile home equipped with skirting panels and a typical mounting channel found in the prior art.
Figure 2:
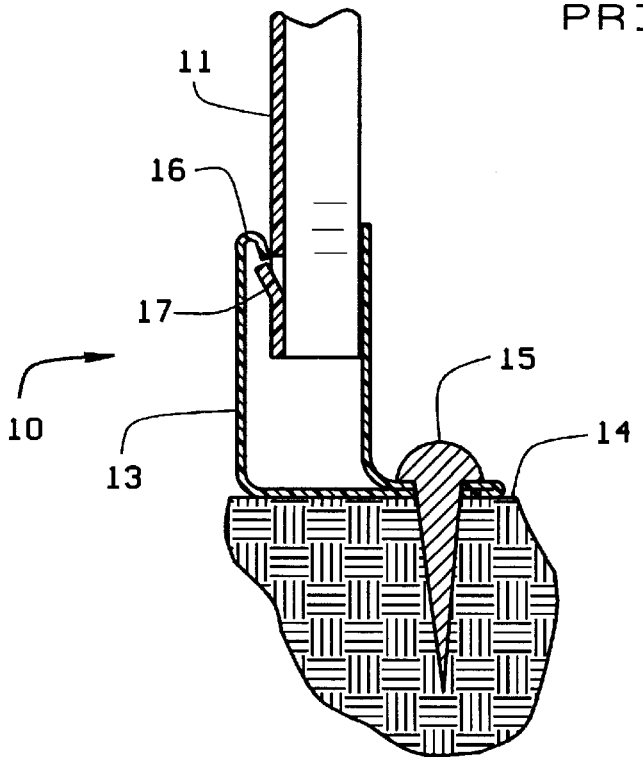
FIG. 2 PRIOR ART
FIG. 2 is a cross-sectional view of a typical mounting channel of the prior art engaged with a skirting panel.
Figure 3:
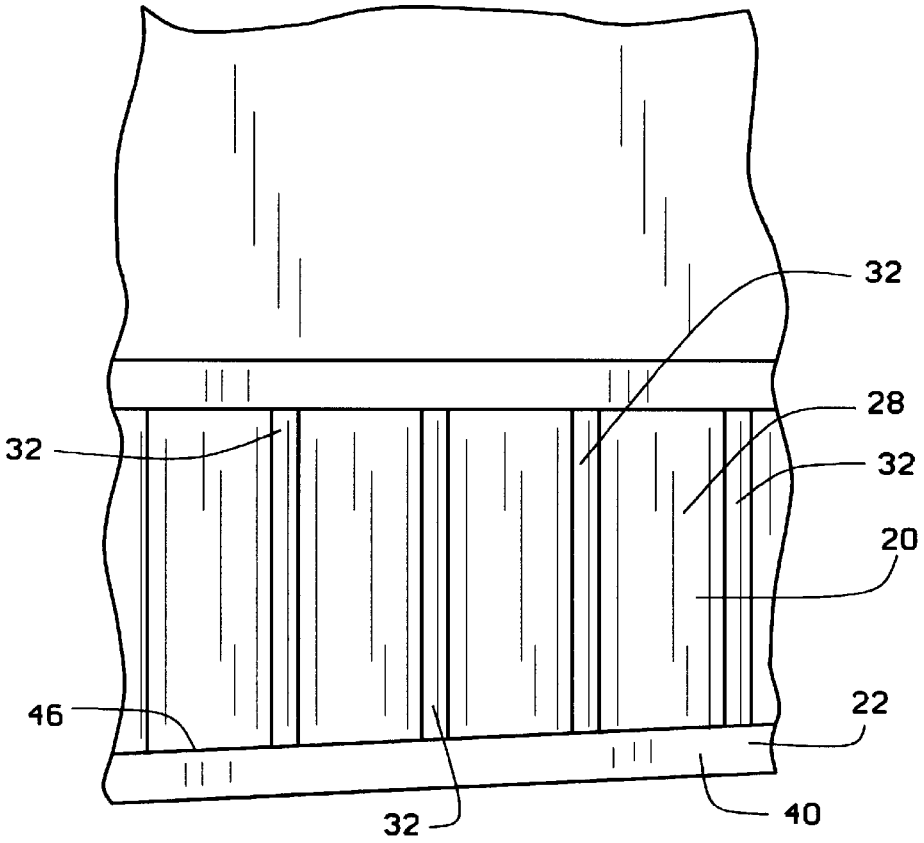
FIG. 3 is a frontal view of a mobile home equipped with panel skirting and mounting channels of the present invention.
Figure 4:
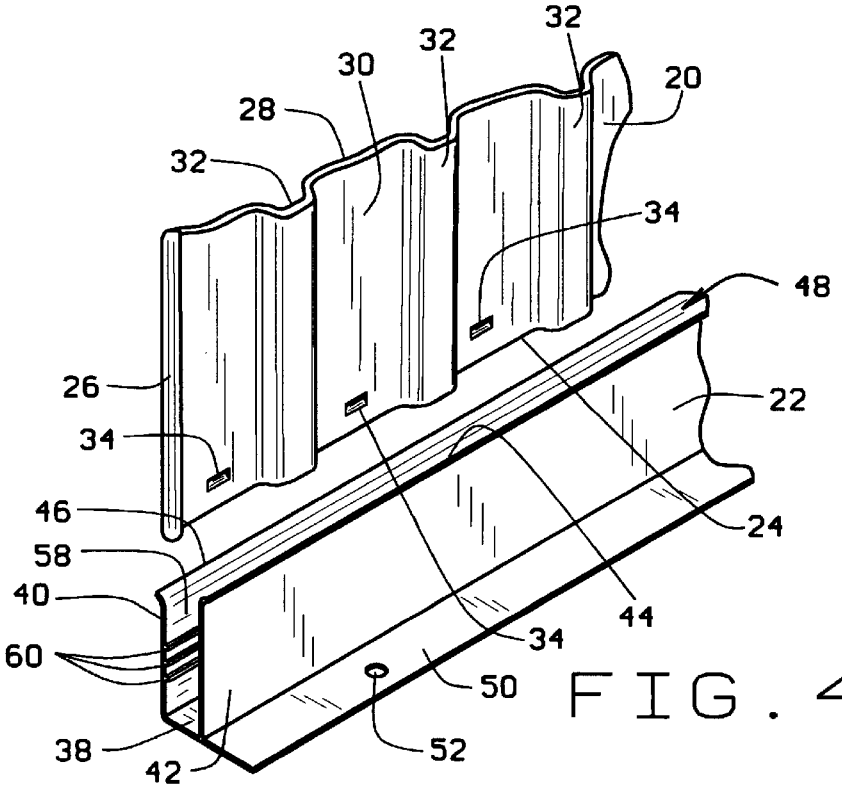
FIG. 4 is a partial isometric, exploded view of the mounting channel and panel skirting of the present invention.

The skirting panels 20 of the invention shown in FIGS. 3–7 are, for the most part, substantially constructed in the same manner as prior art skirting panels. The panel is generally square with opposite top (not shown) and bottom 24 horizontal edges, and opposite left (not shown) and right 26 vertical edges. The panels can be square or rectangular and the skirting panel 20 shown in FIGS. 3 and 4 has a general rectangular configuration with its horizontal length being slightly greater than its vertical height. The panel has opposite front 28 and back 30 surfaces and as shown in FIGS. 3 and 4 has a corrugated configuration giving the panel added strength.

Figure 5:
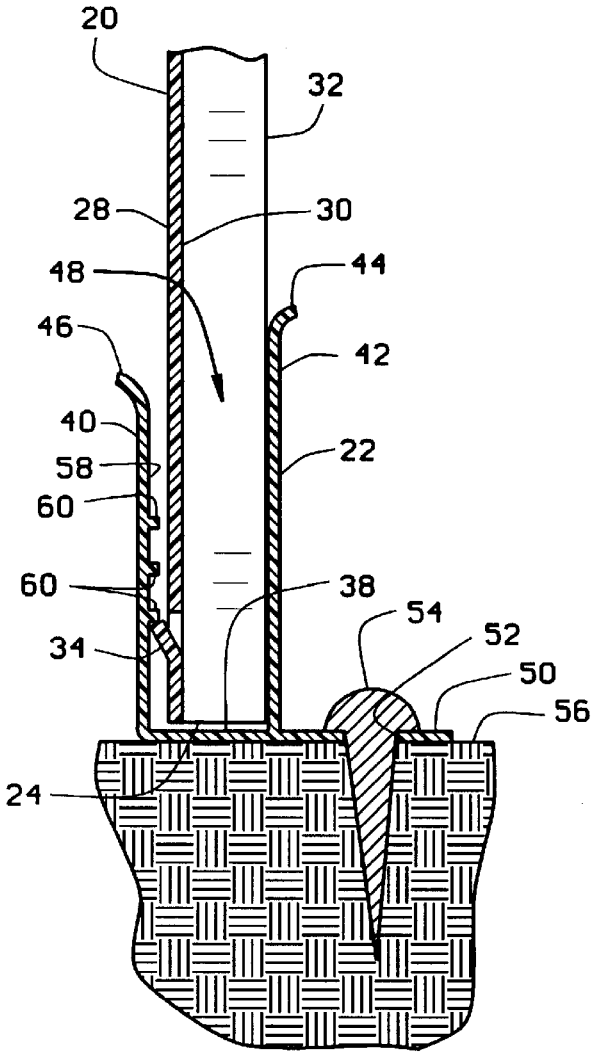
FIGS. 5 and 6 are partial cross-sectional views through the skirting panel and mounting channel of the invention.
Figure 6:
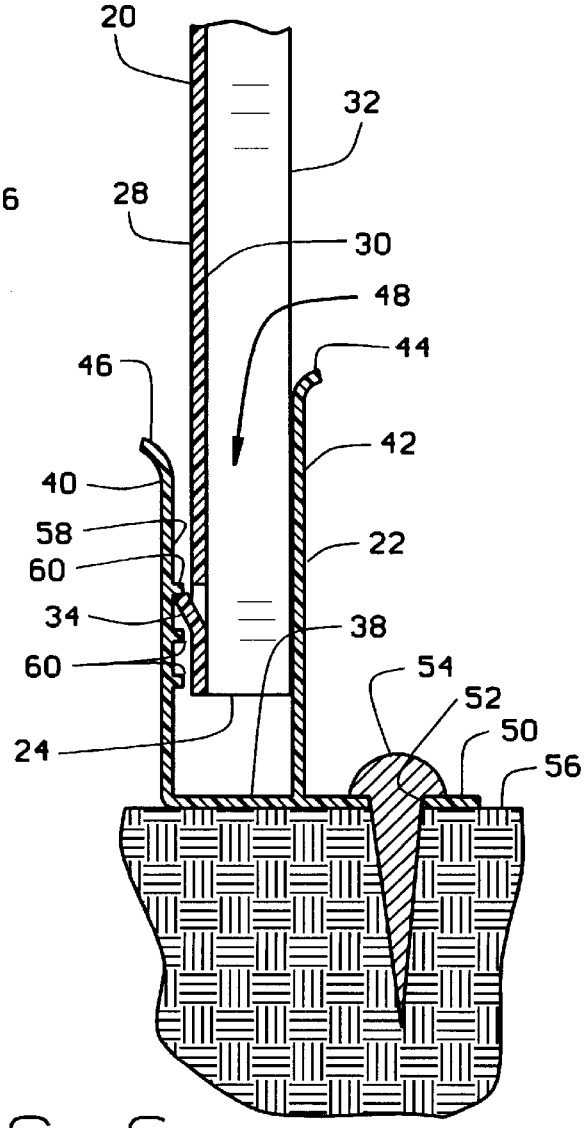
Figure 7:
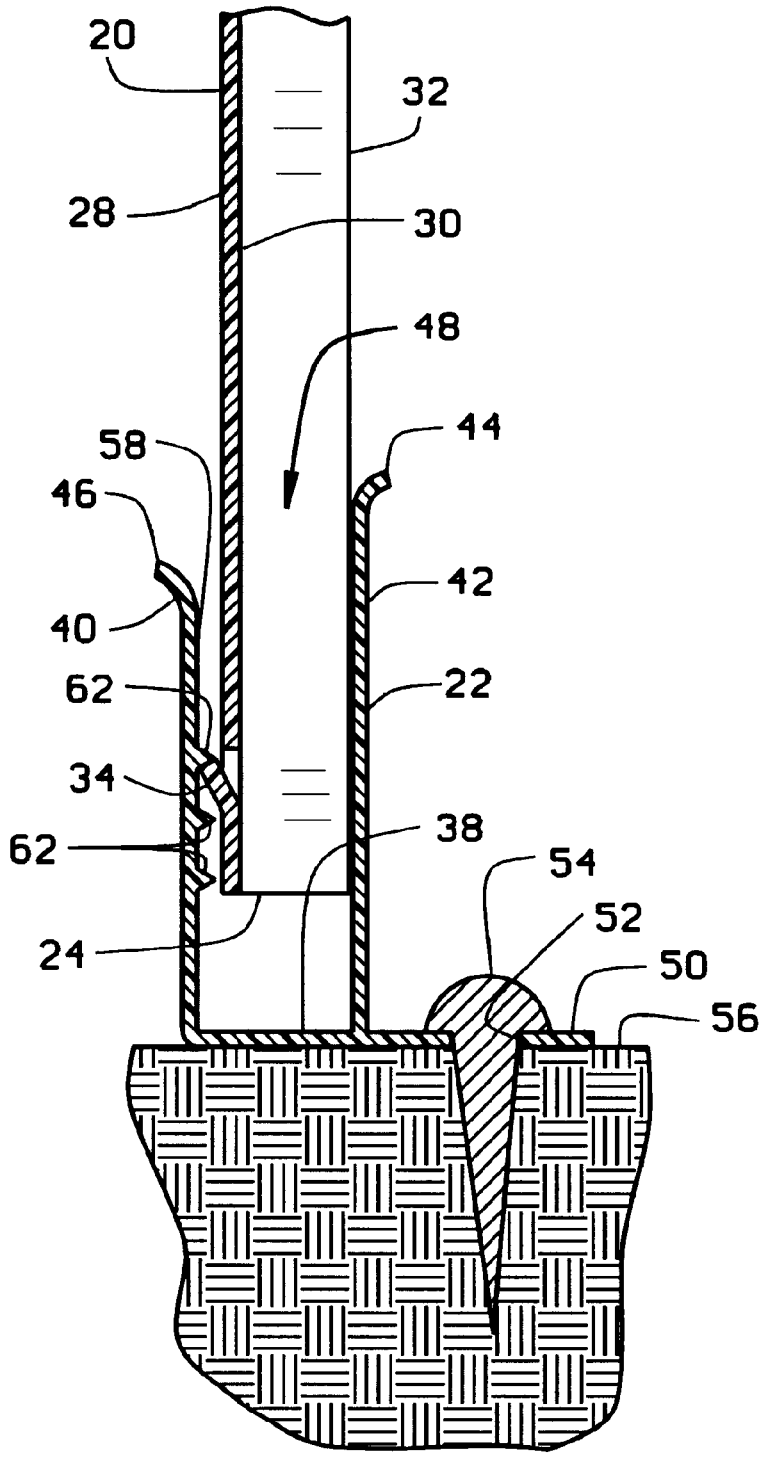
FIG. 7 is another embodiment of the invention illustrating the mounting channel with barbs of a triangular cross-section.

Adjacent the panel bottom edge 24, a plurality of button punches 34 are formed between each of the panel corrugations 32. The button punches 34 have been employed with prior art panels and are easily formed in the panels. They are basically formed by making cuts adjacent the bottom edge of the panel, where the cuts have an inverted U-shape. This forms a tab inside each of the inverted U-shaped cuts that is bent along its bottom edge outwardly of the panel front surface 28 forming the button punch or tab 34. As best seen in FIGS. 5–7, each button punch or tab 34 extends upwardly as it extends outwardly from the panel front surface 28. Also, as shown in FIG. 4, each of the button punches 34 are arranged in a horizontal line spaced slightly vertically above the panel bottom edge 24.

The mounting channel 22 has an elongated length and a generally U-shaped cross-section. The channel is comprised of a generally horizontal base 38, a generally vertical front wall 40, and a generally vertical rear wall 42. The base, front wall and rear wall of the channel are all molded integrally together. As best seen in FIGS. 5–7, the channel rear wall 42 has a top edge 44 that is spaced slightly vertically above the top edge 46 of the channel front wall 40. The rear wall top edge 44 is bent or curved slightly away from the interior of the groove 48 of the channel interior. The front wall top edge 46 also bends or curves slightly away from the interior of the channel groove 48. These curved configurations of the top edges of the front and rear channel walls makes it easier to align the skirting panel 20 with the channel groove 48 when assembling a panel into the groove. First the panel bottom edge is engaged against the back wall 42 above the groove 48 and the top edge 46 of the front wall 40 and is then inserted downwardly into the groove.

The base 38 of the mounting channel extends rearwardly of the channel rear wall 42 a short distance forming a flange 50. The flange 50 extends the entire length of the channel and is provided with holes 52 specially arranged along the flange. The holes 52 are provided to receive a spike or nail 54 used in holding the mounting channel 22 in its position along the ground 56 or other support surface spaced below the periphery of the mobile home.

In the interior of the channel groove 48 along an interior surface 58 of the channel front wall 40, are provided a plurality of rows of barbs 60. As shown in the drawing figures, the plurality of rows of barbs numbers three, however, a greater or lesser number of rows may be employed on the front wall interior surface. Each of the rows of barbs 60 extends a short distance into the groove 48 from the front wall interior surface 58 and each extends horizontally along the entire length of the mounting channel 22. The rows of barbs 60 are also spaced a short vertical distance from each other.

As shown in FIGS. 5–7, the width dimension of the channel groove 48 between the front wall 40 and rear wall 42 and the width dimension of the skirting panel 20 is such that the button punch or tab 34 will be deflected inwardly against the resilient bias of the skirting panel material, causing the button punch 34 to pass over one or more of the barbs 60 as the bottom edge of the skirting panel 20 is inserted into the channel groove 48. Once the skirting panel is inserted into the channel groove, the button punch 34 engages against the bottom edge of the last barb 60 which it passed over when the panel was inserted, thereby resisting removal of the skirting panel bottom edge 24 from the channel groove 48. Depending on the vertical spacing between the mounting channel 20 and "the bottom peripheral" edge of the mobile home floor from which the skirting panel 20 is suspended, the button punch 34 will engage against a different one of the barbs 60 when inserted into the channel groove interior 48 as illustrated in FIGS. 5 and 6.

FIG. 7 shows a variant embodiment of the invention that is substantially identical to that previously described with reference to FIGS. 3–6, except that each of the rows of barbs 62 has a generally triangular cross-section where the rows of barbs 60 in the previously described embodiment had a generally square cross-section.

In use of the skirting assembly of the invention, each of the skirting panels 20 assembled to the floor perimeter of the mobile home have their top edges (not shown) secured to the bottom edge of the mobile home in any conventional manner. With the skirting panels 20 suspended from the mobile home periphery, the panel bottom edges 24 are then inserted into the channel 22 which has been previously secured to the ground or supporting surface 56 just below the perimeter of the mobile home floor. The panel bottom edges 24 are inserted into the channel groove 48 to the extent possible, depending on the vertical spacing between the mobile home floor perimeter and the ground or support surface beneath the perimeter. As the skirting panel bottom edges 24 are inserted into the channel groove 48, the button punches 34 pass over the barbs 60 and engage the underside of the last barb passed over to secure the bottom edges in the channel.

In an alternate embodiment of the invention, button punches may be provided in each skirting panel adjacent the panel top edge in the same manner as those provided at the bottom edge of each panel. A mounting channel identical to the mounting channel 22 employed along the ground or support surface of the mobile home periphery is attached to the underside of the mobile home flooring The panel top edge is then inserted into this channel attached to the bottom of the mobile home flooring at its periphery and is held in the channel by the engagement of the button punches 34 with the barbs provided in these channel members.

While the present invention has been described by reference to a specific embodiment, it should be understood that modifications and variations of the invention may be constructed without departing from the scope of the invention defined in the following claims.

What is claimed is:

1. A mounting assembly for skirting of a mobile home comprising:

a plurality of skirting panels, each of said panels having at least one protrusion along an edge thereof; and a mounting channel for alignment with a perimeter of the mobile home, said mounting channel having a plurality of barbs along an interior surface thereof, the barbs being positioned as to engage at least one of said protrusions as said panels are inserted into said mounting channel to thereby become secured thereto.

2. The mounting assembly of claim 1 wherein the mounting channel has a length and the plurality of barbs extend the length of the mounting channel.

3. The mounting assembly of claim 2 wherein there are three barbs spaced vertically relative to each other on the interior surface, the vertical spacing of the barbs enabling at least two panel protrusions to engage barbs at different vertical spacings.

4. The mounting assembly of claim 3 wherein the plurality of barbs are integrally molded with the mounting channel.

5. The mounting assembly of claim 1 wherein each barb has a triangular cross section.

6. The mounting assembly of claim 1 wherein the protrusions on the skirting panels are button punches.

7. A method of skirting a mobile home with a plurality of skirting panels and a mounting channel, the method comprising the steps of:

providing a plurality of barbs along an interior surface of the mounting channel;

providing protrusions on the skirting panels;

aligning the mounting channel with a perimeter of the mobile home;

fixing the mounting channel to the ground;

inserting the skirting panels stationary to the mobile home perimeter;

engaging each skirting panel protrusion with at least one of the plurality of barbs of the mounting channel to vertically lock the panel to the channel; and attaching the skirting panels to a bottom of the mobile home.

8. The method of claim 7 wherein the engaging step includes engaging the protrusion of a first one of said skirting panels with a first one of said plurality of barbs, and engaging the protrusion of a second one of said skirting panels with a second one of said plurality of barbs.

9. A mounting channel for a mobile home skirting assembly, said channel comprising a front wall and a rear wall, the front and rear walls defining a groove therebetween, the front wall having a plurality of barbs protruding into said groove, at least one of said barbs protruding into said groove from a portion of the front wall which is vertically spaced from a top edge thereof.

10. The mounting channel of claim 9 wherein the front wall has three barbs protruding into said groove.

11. The mounting channel of claim 9 wherein at least one of said plurality of barbs protrudes into said groove from portions of the front wall which are vertically spaced from the top edge thereof.

12. The mounting channel of claim 11 wherein all of said plurality of barbs protrude into said groove from portions of the front wall which are vertically spaced from the top edge thereof.

13. The mounting channel of claim 9 further comprising a base from which the front and rear walls extend upwardly, wherein the at least one barb protrudes from a portion of the front wall which is vertically spaced from the base.

14. The mounting channel of claim 9 wherein the top edge of at least the front wall is flared.

15. The mounting channel of claim 14 wherein the flared top edge is flared outwardly and upwardly from said groove.

16. The mounting channel of claim 9 wherein the mounting channel is integrally formed as one piece.

* * * * *